US009693662B2

(12) United States Patent
Tadina et al.

(10) Patent No.: US 9,693,662 B2
(45) Date of Patent: Jul. 4, 2017

(54) VACUUM CLEANER NOISE AND VIBRATION REDUCTION SYSTEM

(71) Applicants: NELA RAZVOJNI CENTER D.O.O. PODRUZNICA OTOKI, Zelezniki (SI); DOMEL D.O.O., Zelezniki (SI); ARCELIK A.S., Istanbul (TR)

(72) Inventors: Matej Tadina, Podplat (SI); Janez Rihtarsic, Zelezniki (SI); Igor Markic, Skofja Loka (SI); David Koblar, Zelezniki (SI); Andrej Bicek, Vrhnika (SI)

(73) Assignees: NELA rasvojni center d.o.o. Podruznica OTOKI, Zeleniki (SI); Domel d.o.o., Zelezniki (SI); Arcelik A.S., Istanbul (TR)

( * ) Notice: Subject to any disclaimer, the term of this patent is extended or adjusted under 35 U.S.C. 154(b) by 0 days.

(21) Appl. No.: 14/538,631

(22) Filed: Nov. 11, 2014

(65) Prior Publication Data

US 2015/0128375 A1 May 14, 2015

(30) Foreign Application Priority Data

Nov. 11, 2013 (EP) ..... 13192319

(51) Int. Cl.
*A47L 9/00* (2006.01)
*A47L 9/22* (2006.01)

(52) U.S. Cl.
CPC ..... *A47L 9/0081* (2013.01); *A47L 9/22* (2013.01)

(58) Field of Classification Search
CPC ..... A47L 9/0081; A47L 9/22; A47L 9/1427; A47L 5/28; A47L 5/14
See application file for complete search history.

(56) References Cited

U.S. PATENT DOCUMENTS 5,159,738 A * 11/1992 Sunagawa ..... A47L 9/0081 15/326
5,293,664 A * 3/1994 Lim ..... A47L 9/22 15/326

(Continued)

FOREIGN PATENT DOCUMENTS

DE 7908622 U1 2/1980
DE 19616156 C1 10/1997

(Continued)

OTHER PUBLICATIONS

ISA European Patent Office, Extended European Search Report Issued in Application No. 13192319, Apr. 22, 2014, Germany, 8 pages.

*Primary Examiner* — Dung Van Nguyen
(74) *Attorney, Agent, or Firm* — McCoy Russell LLP

(57) ABSTRACT

A motor enclosure for a vacuum cleaner motor having an air inlet and an air outlet may enclose the vacuum cleaner motor and the motor enclosure may form a channel structure around the vacuum cleaner motor for guiding at least a part of an airflow exiting the air outlet of the vacuum cleaner motor during use to turn by an angle of 360° or more about an axis that is perpendicular to a line between the air inlet and the air outlet of the vacuum cleaner motor. Further, a mounting suspension may connect the vacuum cleaner motor to a housing of the vacuum and may suspend the motor enclosure, for example such that the motor enclosure is only connected to the suspension and the motor enclosure is connected to the motor and the vacuum cleaner only via the suspension.

12 Claims, 5 Drawing Sheets

(56) References Cited

U.S. PATENT DOCUMENTS

| | | | | |
|---|---|---|---|---|
| 5,365,633 | A * | 11/1994 | Sunagawa | A47L 9/0081 15/326 |
| 6,810,989 | B1 * | 11/2004 | Dantlgraber | H02K 5/24 123/195 R |
| 7,596,829 | B2 * | 10/2009 | Song | A47L 9/22 15/326 |
| 7,774,898 | B2 * | 8/2010 | Hong | A47L 5/362 15/326 |
| 8,689,397 | B2 * | 4/2014 | Van De Veen | A47L 9/0081 15/326 |
| 2006/0096058 | A1 * | 5/2006 | Oh | A47L 9/0081 15/326 |
| 2006/0213022 | A1 * | 9/2006 | Oh | A47L 9/0081 15/326 |
| 2006/0254022 | A1 * | 11/2006 | Oh | A47L 9/0081 15/412 |
| 2006/0257269 | A1 * | 11/2006 | Lee | A47L 9/22 417/313 |
| 2006/0277711 | A1 * | 12/2006 | Hong | A47L 9/0081 15/326 |
| 2010/0218341 | A1 * | 9/2010 | Sato | A47L 9/22 15/412 |

FOREIGN PATENT DOCUMENTS

| | | | |
|---|---|---|---|
| EP | 2436291 | A1 | 4/2012 |
| JP | 5176868 | A | 7/1993 |

* cited by examiner

VACUUM CLEANER NOISE AND VIBRATION REDUCTION SYSTEM

CROSS REFERENCE TO RELATED APPLICATIONS

The present application claims priority to European Patent Application No. 13 192 319.5, filed on Nov. 11, 2013, the entire contents of which are hereby incorporated by reference for all purposes.

DESCRIPTION

Field of the Invention

The present invention relates to a motor enclosure for a vacuum cleaner motor, noise reducing assembly for a vacuum cleaner, mounting suspension for a vacuum cleaner motor and a vibration reducing assembly for a vacuum cleaner.

Background of the Invention

In a vacuum cleaner, there are two primary sources of noise. The first source of noise is the noise that is generated by mechanical vibrations of the vacuum cleaner motor and the second source is the noise generated by the air flow of the vacuum cleaner, specifically the airflow exiting the motor. It is of general interest to reduce the amount of these noises, in order to reduce as much as possible any inconvenience to an operator of the vacuum cleaner due to the noise. There have been attempts to provide noise reduction by lengthening the path of flow through the vacuum cleaner. However, these noise reduction configurations still produce a considerable amount of noise and there is a need for further improvement.

DESCRIPTION OF THE INVENTION

The problem underlying the present invention is to provide an arrangement for reducing the noise generated by the exhaust air flow in a vacuum cleaner and/or to reduce the noise due to mechanical vibrations of the motor.

The above-mentioned problem is solved by a motor enclosure for a vacuum cleaner motor having an air inlet and an air outlet.

In one example, the motor enclosure may be configured to enclose the vacuum cleaner motor, wherein the motor enclosure forms a channel structure around the vacuum cleaner motor for guiding at least a part of an airflow exiting the outlet of the vacuum cleaner motor during use to turn by an angle of 360° or more about an axis that is perpendicular to a line between the inlet and the outlet of the vacuum cleaner motor.

The turning of the airflow by at least 360° in the motor enclosure (also called capsule in the following) has the advantage that the noise from the airflow exiting the motor enclosure may be reduced. This is due to internal reflections of the sound waves that lead to the absorption of energy in the sound waves, which may include partial back reflection of sound waves opposite to the flow. It is to be understood that there will be a spread in the angle of the airflow exiting the motor enclosure due to a turbulent flow, for example by ±10°.

According to a development of the motor enclosure, the turning angle may be in the range of 360° to 450°, e.g., the turning angle may be 360° or 450°. When the angle is 360°, the airflow has made one complete revolution about an axis perpendicular to the flow that exits the vacuum cleaner motor before exiting the motor enclosure. The air exits the motor and for example hits the inside of a bottom wall of the motor enclosure where it is deflected and is guided to pass around the motor. When the angle is 450°, there is a further deflection by 90° of the airflow such that the air that exits the motor enclosure may flow parallel to the mentioned bottom wall of the motor enclosure, but on the outer side thereof.

In a further development, the motor enclosure may comprise one or more baffles to form the channel structure. The material of the one or more baffles may comprise foam. This may be a convenient way to guide the flow of air in the motor enclosure.

According to another development the motor enclosure comprises a double-walled section forming a part of the channel structure for guiding the airflow having turned by an angle of at least 360°, e.g. wherein the double-walled section comprises an outlet for the airflow to exit the motor enclosure.

In a further development, the motor enclosure may further comprise sound absorbing material provided on a surface of the channel, e.g. on a surface of the channel that deflects the airflow exiting the outlet of the vacuum cleaner motor. This may further reduce the noise due to the airflow.

According to another development, the motor enclosure may comprise a bottom part configured to be connected to a bottom part of a mounting suspension and a top part configured to be connected to a top part of the mounting suspension. An exemplary mounting suspension will be described below.

In a further development, the motor enclosure may comprise a bottom part configured to be connected to a bottom part of a mounting suspension and a top part configured to be connected to a top part of the mounting suspension.

In one example, a noise reducing assembly for a vacuum cleaner may comprise a motor enclosure such as the motor enclosure described above, with a vacuum cleaner motor being enclosed by the motor enclosure.

As shown, the motor enclosure may comprise one or more baffles 5 to form the channel structure and to guide the flow of air in the motor enclosure. The material of the one or more baffles 5 may comprise foam.

Further, in the depicted embodiment, the motor enclosure comprises a double-walled section 17 forming a part of the channel structure for guiding the airflow having turned by an angle of at least 360°. As shown, the double-walled section may comprises an outlet 18 via which the airflow may exit the motor enclosure.

According to a development, the noise reducing assembly may comprise the mounting suspension that will be described below.

A mounting suspension may be configured for connecting a vacuum cleaner motor to a housing of the vacuum cleaner, and the mounting suspension may further be configured for suspending a motor enclosure, e.g. such that the motor enclosure is only connected to the suspension and the motor enclosure is connected to the motor and the vacuum cleaner only via the suspension.

Therefore, in one example, the motor enclosure is only in connection with the suspension and vibrations of the motor are not directly transferred to the motor enclosure and additionally, vibrations of the motor enclosure are not directly transferred to the housing of the vacuum cleaner. For example, the motor enclosure may be connected directly to the suspension and connected indirectly to the vacuum cleaner motor and the housing of the vacuum cleaner via the suspension. This may considerably reduce the noise due to vibrations from the motor that may be transmitted to the housing of the vacuum cleaner.

According to a development of the mounting suspension, the mounting suspension may comprise a bottom part configured to be connected to a bottom section of the vacuum cleaner motor and further configured to be connected to a housing of a vacuum cleaner; and a top part configured to be connected to a top section of the vacuum cleaner motor and further configured to be connected to the housing of the vacuum cleaner.

In a further development, the bottom part of the mounting suspension may comprise one, two or more cylindrical elements, each having a circumferential protrusion to which a bottom part of the motor enclosure is connectable. For example, the bottom part of the motor enclosure may be configured to be connected to the circumferential protrusion(s) of the cylindrical element(s). The cylindrical elements may have hollow portions, and pins arranged on the housing of the vacuum cleaner may fit into the hollow portions, for attaching the bottom part of the motor to the housing via the cylindrical elements, e.g. via the connection between the pins and the hollow portions of the cylindrical elements.

According to another development, the top part of the mounting suspension may be configured to be at least partially arranged between a top part of the motor enclosure and the motor. Thus, there may be no direct contact between the top part of the motor enclosure and the motor.

In a further development, the material of the suspension may comprise rubber. This material may be suitable for the suspension and its parts or elements.

In one example, a vibration reducing assembly may comprise a vacuum cleaner motor; a motor enclosure enclosing the vacuum cleaner motor; and a mounting suspension.

A vacuum cleaner may comprise the noise reducing assembly and/or the vibration reducing assembly described herein.

Further features and advantages of the present invention will be described in the following with reference to the figures, which illustrate only examples of embodiments of the present invention. The illustrated and described features may be suitably combined with each other.

DESCRIPTION OF THE EMBODIMENTS

Figure 1:
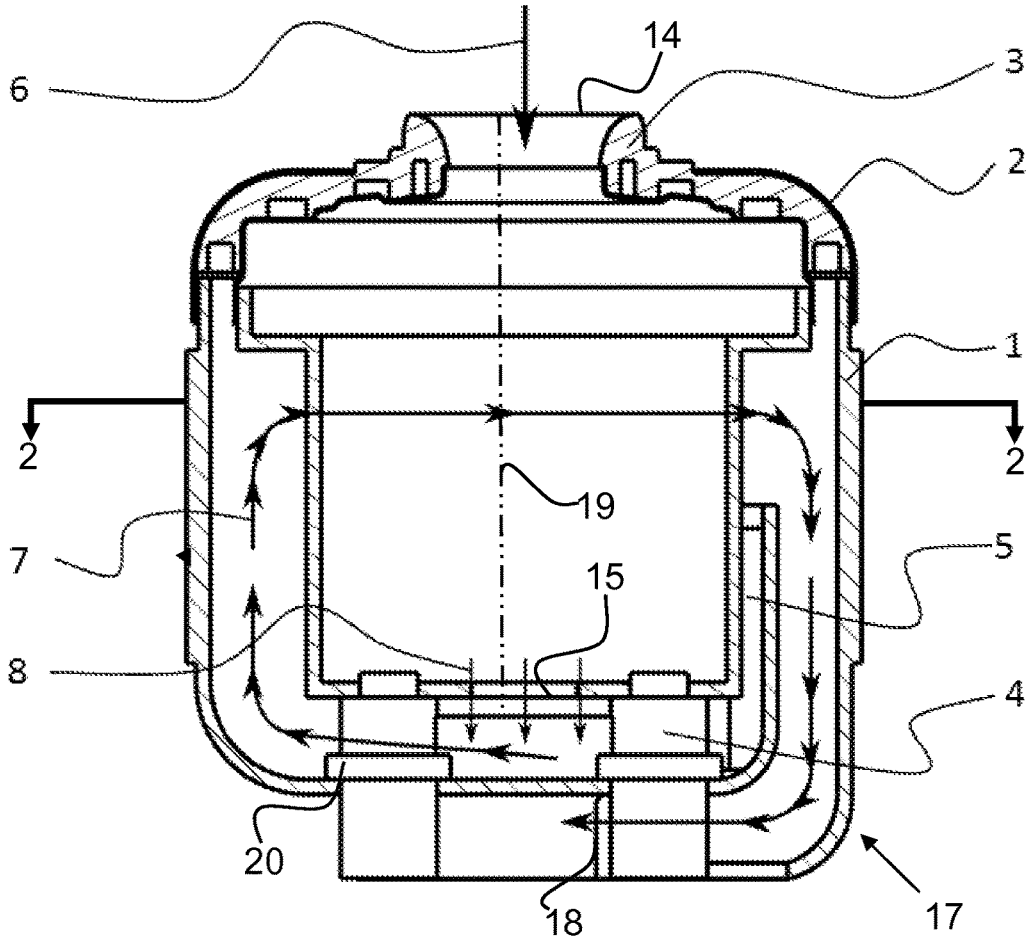
FIG. 1 illustrates an embodiment of a noise reducing assembly and a vibration reducing assembly.
Figure 2:
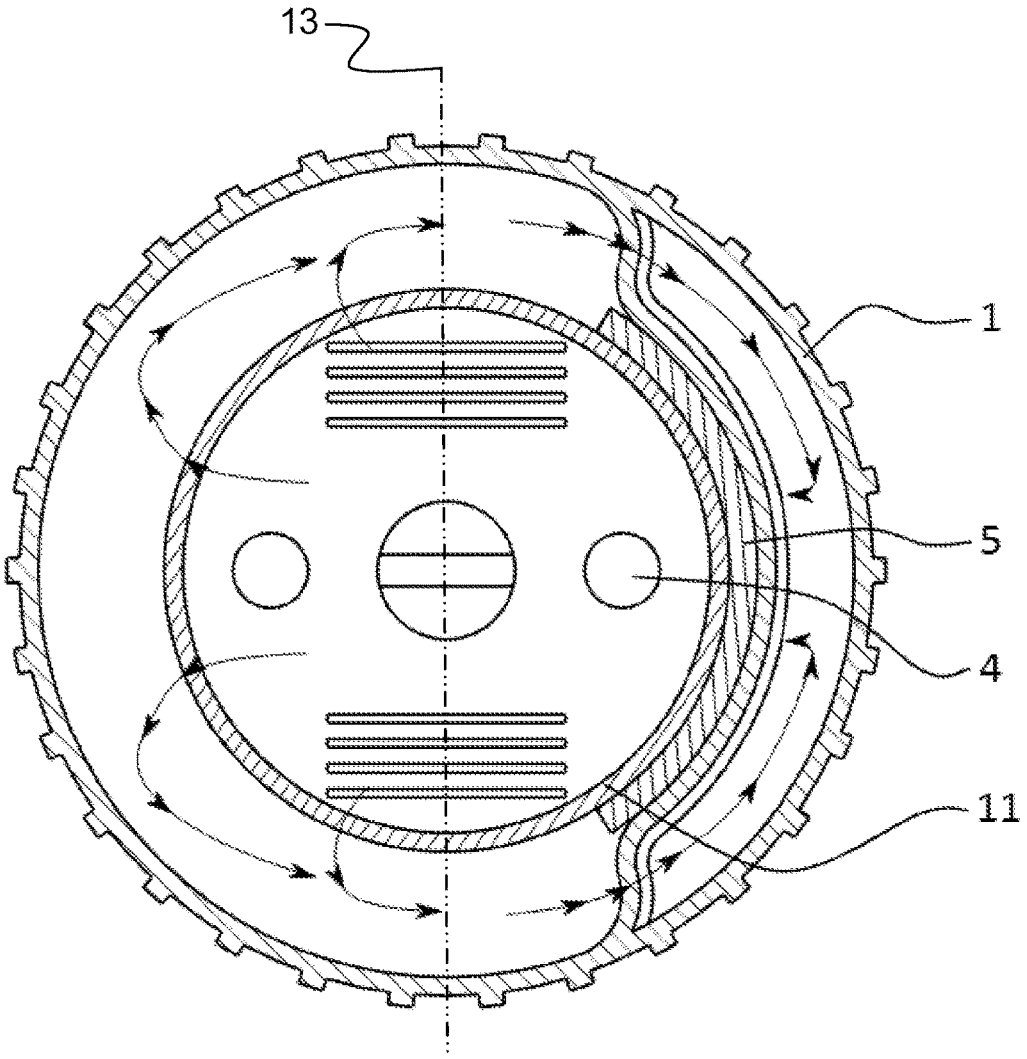
FIG. 2 shows a view of a cross section perpendicular to the plane of FIG. 1.
Figure 3:
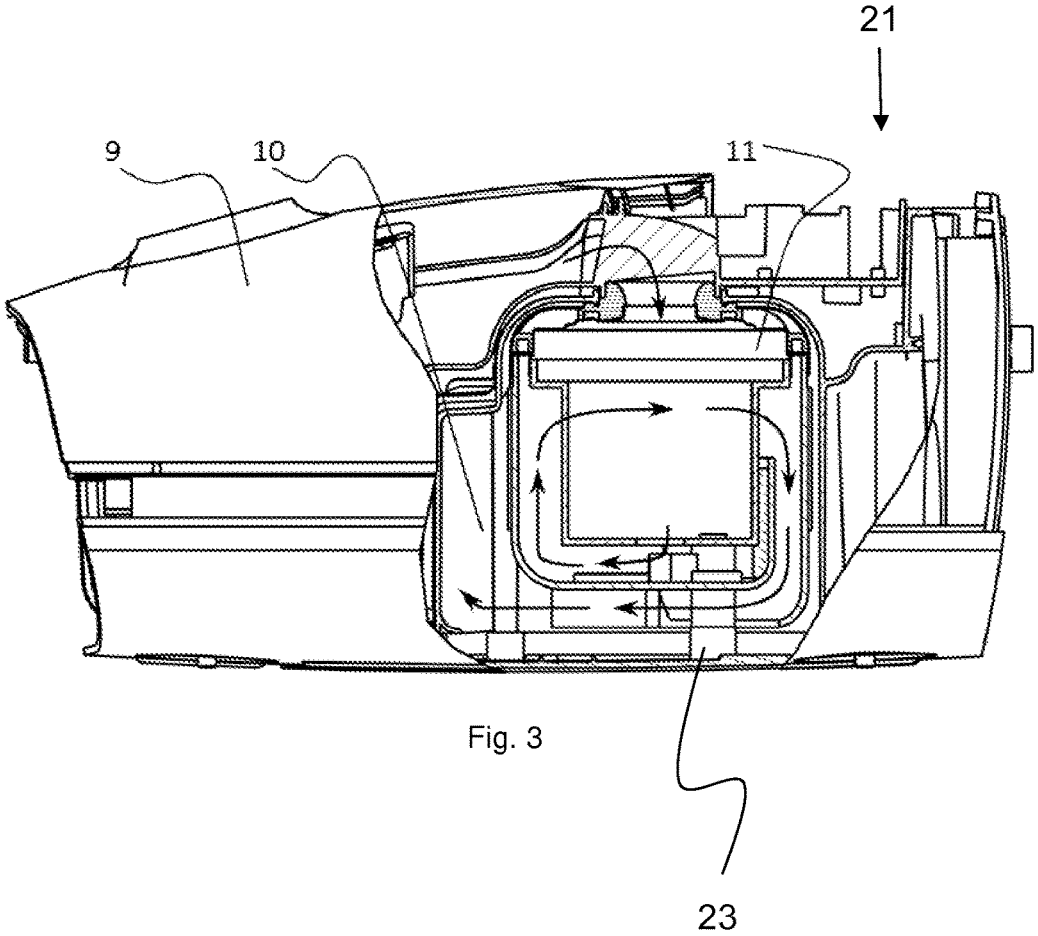
FIG. 3 illustrates a housing of a vacuum cleaner including the noise reducing assembly and the vibration reducing assembly of FIG. 1.

FIG. 1 shows an embodiment of a noise reducing assembly and a vibration reducing assembly which may be included in a vacuum cleaner. FIG. 2 shows a view of a cross section perpendicular to the plane of FIG. 1. FIG. 3 illustrates a housing of a vacuum cleaner including the noise reducing assembly and the vibration reducing assembly of FIG. 1. Moreover, FIGS. 4A-B and 5A-B illustrate an embodiment of a mounting suspension for a vacuum cleaner motor. The embodiment shown in FIGS. 1, 2 and 3 relates to a noise and vibration reduction assembly which effectively reduces the transfer of vibrations and reduces noise caused by operation of the vacuum cleaner motor 11.

The operation of the vacuum cleaner appliance 9 causes the noise which is of aerodynamic and structural origin. The vacuum cleaner appliance 9 collects solid and fluid particles and airflow is used for their transport from cleaning surfaces to a dust collecting compartment of the vacuum cleaner appliance. From the dust collecting compartment, an airflow path 6 continues towards the inlet of a noise reduction assembly.

This noise reduction assembly includes a motor enclosure 1, 2 that is configured to enclose the vacuum cleaner motor 11, wherein the motor enclosure 1, 2 forms a channel structure around the vacuum cleaner motor 11 for guiding at least a part of an airflow exiting the outlet 15 of the vacuum cleaner motor 11 during use to turn by an angle of 360° or more about an axis 13 that is perpendicular to a line 19 between the inlet and the outlet of the vacuum cleaner motor 11. Motor enclosure 1, 2 includes an air inlet 14 at an upper end thereof and an air outlet 18 at a bottom end thereof.

Moreover, the depicted embodiment also includes a vibration reducing assembly that comprises the vacuum cleaner motor 11; the motor enclosure 1, 2 enclosing the vacuum cleaner motor 11; and a mounting suspension 3, 4. The mounting suspension includes an upper part 3 and a bottom part 4 (referred to alternatively herein as a lower part 4), and is configured for connecting the vacuum cleaner motor 11 to the housing of the vacuum cleaner, and the mounting suspension 3, 4 is further configured for suspending the motor enclosure 1, 2, e.g. such that the motor enclosure 1, 2 is only connected to the suspension 3, 4, and the motor enclosure 1, 2 is connected to the motor 11 and the housing of the vacuum cleaner 9 only via the suspension 3, 4. In one example, the mounting suspension may be partially or entirely made of rubber. In other examples, the mounting suspension may be made of other materials.

Furthermore, the upper part 3 and bottom part 4 of the suspension may reduce the transfer of vibrations from the vacuum cleaner motor 11 to the vacuum cleaner appliance 9. The upper part 3 guides the airflow 6 to the inlet of the vacuum cleaner motor 11. The airflow 8 exits from the vacuum cleaner motor 11 back into the motor enclosure 1, 2. The airflow 7 is further guided within the noise reduction assembly through the air path formed by the vacuum cleaner motor 11, the motor enclosure housing 1, the upper part 3 and bottom part 4 of the suspension, and foam 5.

The airflow 7 makes the turn for an angle of 360° to 450° within the noise reduction assembly. The airflow 7 exits from the noise reduction assembly into the vacuum cleaner appliance inner housing 10 and is further guided towards the exit 21 of the vacuum cleaner appliance 9. In the inner housing 10 of the vacuum cleaner, the airflow may be turned by another 90° (upwards), yielding a total of 540°. As an option, additional sound absorbing material can be applied on an arbitrary surface which forms the airflow path 7 within the noise reduction assembly.

The upper part 3 and bottom part 4 of the suspension may elastically attach the motor enclosure, comprising parts 1 (lower) and 2 (upper), to the vacuum cleaner motor 11, where the motor enclosure is not directly connected to any other part of the vacuum cleaner appliance 9 and can freely move in space. The motor enclosure comprising parts 1 and 2, together with upper part 3 and bottom part 4 of the mounting suspension, may form a tuned mass damper.

Figure 4A:
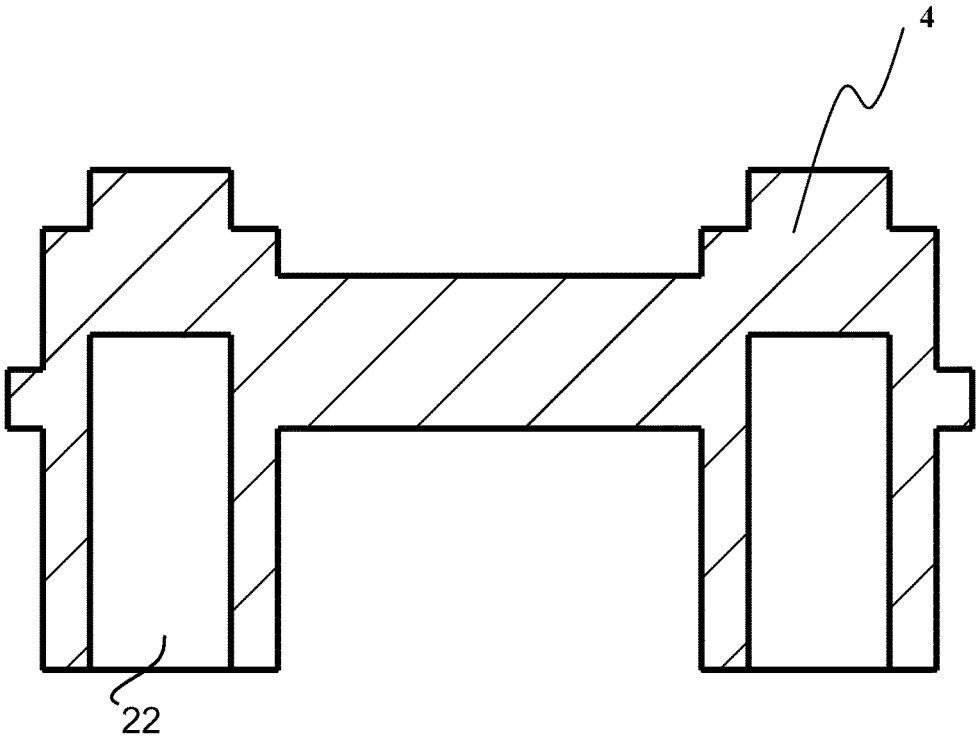
FIG. 4A shows a view of a cross section of an embodiment of a lower part of a mounting suspension for a vacuum cleaner motor.
Figure 4B:
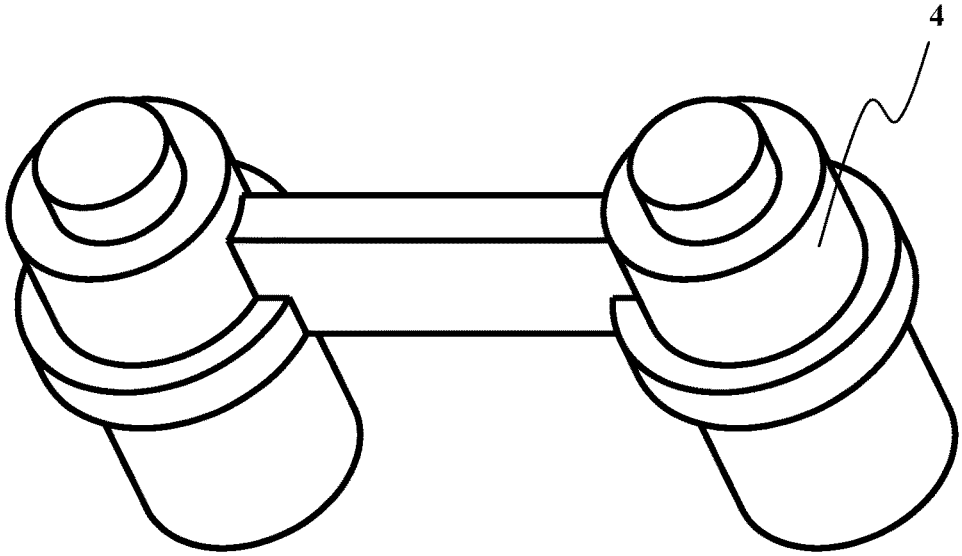
FIG. 4B shows a perspective view of the lower part of the mounting suspension of FIG. 4A.
Figure 5A:
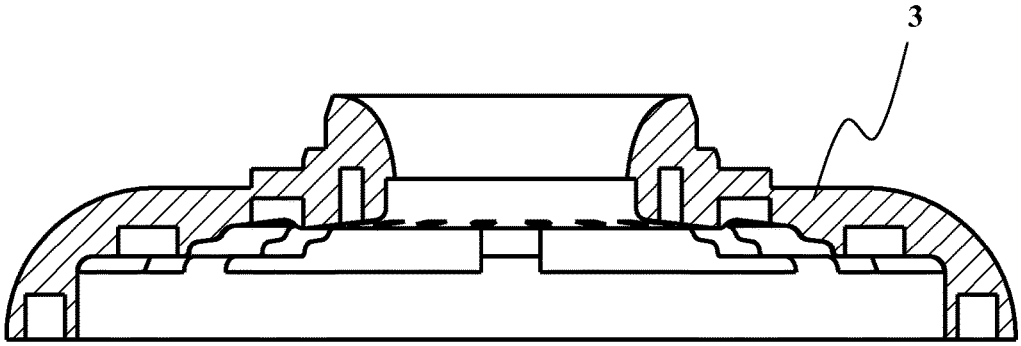
FIG. 5A shows a view of a cross section of an embodiment of an upper part of a mounting suspension for a vacuum cleaner motor.
Figure 5B:
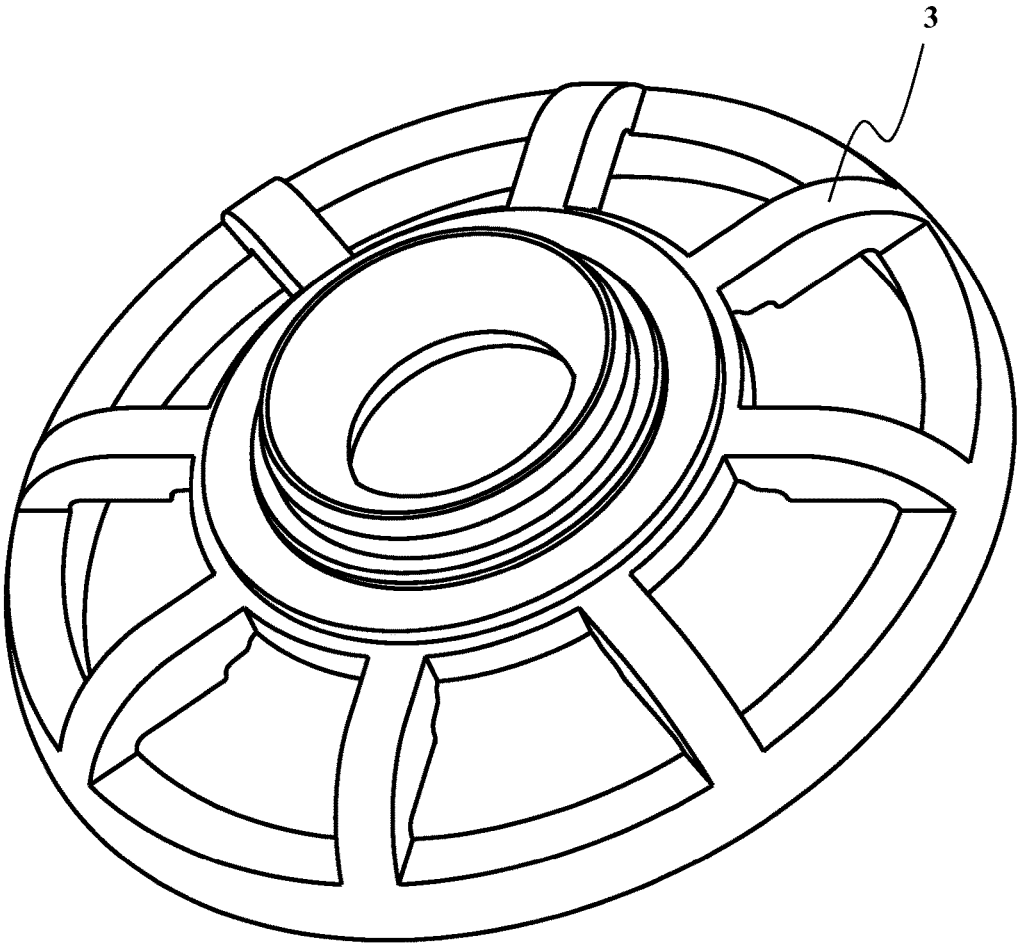
FIG. 5B shows a perspective view of the upper part of the mounting suspension of FIG. 5A.

FIGS. 4A-B illustrates the detailed structure of the lower part 4 of the mounting suspension 3, 4. FIG. 4A is a cross sectional view while FIG. 4B is a perspective view. Similarly, FIG. 5 illustrates the detailed structure of the upper part 3 of the mounting suspension 3, 4. FIG. 5A is a cross sectional view and FIG. 5B is a perspective view. While FIGS. 4A-B are drawn to scale, other relative dimensions may be used without departing from the scope of this disclosure.

The lower suspension 4 of FIGS. 4A-B is in this embodiment manufactured as an integral part 4 with two elements thereof having a hollow portion 22 to be connected to respective pins 23 of the housing of the vacuum cleaner 9 shown in FIG. 3. Moreover, these elements each have a circumferential protrusion 20 of which the lower part of the motor enclosure, i.e. the capsule housing 1 can be suspended. The upper part 3 of the suspension according to FIG. 5 is to be placed between the motor and the capsule cover 2 and thus also suspends the motor enclosure and further suspends the motor to the housing of the vacuum cleaner 9 shown in FIG. 3.

As shown by experiment, the noise and vibration reduction assembly described herein may reduce the noise level by 12 dB compared to the noise level of the vacuum cleaner motor, and the vibration level on the motor may be reduced by 25%.

Some of the existing noise reduction configurations achieve similar or higher level of noise reduction by forcing the airflow through sound absorption foams; however the efficiency of such design drops after some usage time and the noise increases. On the other hand; when using the proposed noise reduction assembly the efficiency and noise level do not change significantly. After normal operational life time of the vacuum cleaner appliance (>500 hours) the optimal efficiency and optimal noise level change for less than ±1%.

Short Summary:

The vacuum cleaner noise and vibration reduction assembly according to the depicted embodiment comprises a capsule housing 1, a capsule cover 2, a bottom 4 and an upper 3 suspension rubber and foam 5. The noise reduction assembly effectively reduces aerodynamic and structurally born noise. The noise reduction assembly airflow path makes the airflow exiting from the vacuum cleaner motor to turn for an angle of 360 to 450 degrees within the noise reduction assembly.

The rubber suspension assembly reduces the vibration transmission to the vacuum cleaner appliance. The rubber suspension parts are unique, because with one rubber part on each side of the motor, fixation in the vacuum cleaner appliance is assured and at the same time the noise reduction assembly is attached to the motor.

The noise reduction assembly guides the airflow exiting from the vacuum cleaner motor to make a turn of 360 to 450 degrees before exiting into inner housing 10 of the vacuum cleaner appliance 9.

Sound absorption foam (e.g., foam 5) can optionally be applied to surface(s) # which re normal to the direction of airflow 8 exiting the vacuum cleaner motor. Sound absorption foam can optionally be applied in addition so that the airflow flows through it.

The sound reduction assembly housing 1 has a cylindrical shape from which the airflow exits only through one opening which is parallel to the bottom of the housing.

The upper 3 and bottom 4 rubber suspension together with sound reduction assembly comprising parts 1 and 2, form a harmonic absorber.

In the depicted embodiment, the housing of the sound reduction assembly is not attached to any part of the vacuum cleaner appliance except through the mounting suspension of the motor.

The invention claimed is:

1. A motor enclosure for a vacuum cleaner motor having an air inlet and an air outlet, the motor enclosure being configured to enclose the vacuum cleaner motor, wherein the motor enclosure forms a channel structure around the vacuum cleaner motor for guiding at least a part of an airflow exiting the air outlet of the vacuum cleaner motor during use to turn by an angle of 360° or more about an axis that is perpendicular to a line between the air inlet and the air outlet of the vacuum cleaner motor, wherein the turning angle is in the range of 360° to 450°, and wherein a bottom part of a mounting suspension comprises one or more cylindrical elements, each cylindrical element having a circumferential protrusion to which a bottom part of the motor enclosure is connectable.

2. The motor enclosure of claim 1, wherein the turning angle is 360° or 450°.

3. The motor enclosure of claim 1, wherein the motor enclosure comprises one or more baffles to form the channel structure.

4. The motor enclosure of claim 3, wherein a material of the one or more baffles comprises foam.

5. The motor enclosure of claim 3, wherein the turning angle is 450°, wherein the airflow exits from a noise reduction assembly into an inner housing of the vacuum cleaner where it is further guided towards an exit of the vacuum cleaner, and wherein in the inner housing of the vacuum cleaner, the airflow is turned by another 90° upwards, yielding a total of 540°.

6. The motor enclosure of claim 1, wherein the motor enclosure comprises a double-walled section forming a part of the channel structure for guiding the airflow having turned by an angle of at least 360°, and wherein the double-walled section comprises the air outlet.

7. The motor enclosure of claim 1, further comprising sound absorbing material provided on a surface of the channel structure that deflects the airflow exiting the air outlet of the vacuum cleaner motor.

8. A motor enclosure for a vacuum cleaner motor having an air inlet and an air outlet, the motor enclosure being configured to enclose the vacuum cleaner motor, wherein the motor enclosure forms a channel structure around the vacuum cleaner motor for guiding at least a part of an airflow exiting the air outlet of the vacuum cleaner motor during use to turn by an angle of 360° or more about an axis that is perpendicular to a line between the air inlet and the air outlet of the vacuum cleaner motor, wherein the motor enclosure comprises a bottom part for being connected to a bottom part of a mounting suspension and a top part for being connected to a top part of the mounting suspension, wherein the top part and bottom part of the mounting suspension elastically attach the motor enclosure to the vacuum cleaner motor, and wherein the bottom part of the mounting suspension is an integral part with two elements thereof each having a hollow portion, the hollow portions configured to be connected to respective pins of the motor enclosure of the vacuum cleaner.

9. A vacuum cleaner, comprising:

a noise reducing assembly comprising a motor enclosure configured to enclose a vacuum cleaner motor, wherein the motor enclosure forms a channel structure around the vacuum cleaner motor for guiding at least a part of an airflow exiting an air outlet of the vacuum cleaner motor during use to turn by an angle of 360° or more about an axis that is perpendicular to a line between an air inlet and the air outlet of the vacuum cleaner motor; and a vibration reducing assembly comprising the vacuum cleaner motor, the motor enclosure, and a mounting suspension configured for connecting the vacuum cleaner motor to a housing of the vacuum cleaner, wherein the mounting suspension is further configured for suspending the motor enclosure, wherein the motor enclosure is connected directly to the mounting suspension, and wherein the motor enclosure is connected indirectly to the vacuum cleaner motor and the housing of the vacuum cleaner via the mounting suspension, and wherein a bottom part of the mounting suspension comprises one or more cylindrical elements, each cylindrical element having a circumferential protrusion to which a bottom part of the motor enclosure is connectable.

10. The vacuum cleaner of claim 9, wherein the mounting suspension elastically attaches the motor enclosure to the vacuum cleaner motor, and wherein the motor enclosure is not directly connected to any other part of the vacuum cleaner and can move freely in space.

11. The vacuum cleaner of claim 9, wherein the motor enclosure and the mounting suspension form a tuned mass damper.

12. The vacuum cleaner of claim 9, wherein the mounting suspension further comprises an upper part, wherein the bottom part is an integral part, and wherein each cylindrical element of the bottom part has a hollow portion, the hollow portions configured to be connected to respective pins of the housing of the vacuum cleaner.

* * * * *